US006452622B2

(12) United States Patent
Pecher et al.

(10) Patent No.: US 6,452,622 B2
(45) Date of Patent: Sep. 17, 2002

(54) DEVICE FOR THERMAL ENERGY INJECTION

(75) Inventors: Harald Pecher, Augsburg; Horst Dauer, Rohrbach, both of (DE)

(73) Assignee: MAN Roland Druckmaschinen AG, Offenbach am Main (DE)

( * ) Notice: Subject to any disclaimer, the term of this patent is extended or adjusted under 35 U.S.C. 154(b) by 0 days.

(21) Appl. No.: 09/790,787

(22) Filed: Feb. 22, 2001

(30) Foreign Application Priority Data

Feb. 23, 2000 (DE) ..... 100 08 213

(51) Int. Cl.[7] ..... B41M 7/00; B41F 23/00; B41F 23/04; B41L 23/00

(52) U.S. Cl. ..... 347/212; 101/463.1

(58) Field of Search ..... 347/212, 102; 399/320, 335, 336; 101/450.1, 463.1; 219/645, 672

(56) References Cited

U.S. PATENT DOCUMENTS 5,213,041 A 5/1993 Kanck
5,832,354 A 11/1998 Kouno et al.
5,951,904 A 9/1999 Jung et al.

FOREIGN PATENT DOCUMENTS

| | | |
|---|---|---|
| DE | 40 11 825 | 10/1991 |
| DE | 196 50 283 | 6/1997 |
| DE | 196 54 269 | 7/1997 |
| EP | 693 371 | 1/1996 |
| EP | 786 337 | 7/1997 |

*Primary Examiner*—Huan Tran
(74) *Attorney, Agent, or Firm*—Cohen, Pontani, Lieberman & Pavane

(57) ABSTRACT

In order to provide, for rotating printing forms consisting of a material into which it is possible to inject energy effectively, that is to say which has high ohmic resistance and is magnetic, a device for thermal energy injection, in which hot gas does not have to be used and by means of which energy injection capable of being controlled with high accuracy in terms of time is possible, there is provided for carrying out the fixing operation means for the inductive fixing of the image information on the rotating printing form.

13 Claims, 2 Drawing Sheets

DEVICE FOR THERMAL ENERGY INJECTION

BACKGROUND OF THE INVENTION

1. Field of the Invention

The invention relates to a device for thermal energy injection, in particular for printing formes imaged by means of a digital imaging system, in particular by means of a laser-induced thermotransfer method.

2. Description of the Related Art

An imaging system of this type for digitally inscribable and re-erasable offset printing formes, in which fixing, that is to say homogeneous heating, of the printing-forme surfaces is carried out, is known from EP 0 693 371 B1.

The imaging unit operates on the outer-drum principle, in which a narrow ink ribbon similar to a typewriter ink ribbon is guided past the rapidly rotating impression cylinder, whilst a laser beam transfers the layer of the ink ribbon onto the impression cylinder by means of heat. This results in the ink-carrying image parts.

After imaging from the digital data stock, the printing forme is fixed for greater durability, that is to say the ink-carrying image parts are anchored to the printing forme.

After an order has been printed out, the rubber blankets are washed, and the printing forme is freed of ink residues and of the printing layer with the aid of a nonwoven and special washing agents. A bare cylinder is then available again for the next imaging operation.

In the fixing step, the imaged printing forme is heated to a surface temperature of between 170° C. and 210° C. by a dryer in the form of a hot-air blower which can be thrown onto the rotating printing forme, in particular a printing forme sleeve, and can be thrown off the latter again.

Although this fixing by hot gas is independent of the material of the printing forme, introducing hot gases into the printing machine in this way nevertheless presents problems and is undesirable.

SUMMARY OF THE INVENTION

The object of the present invention is to provide for rotating printing formes consisting of a material into which energy can be effectively introduced, that is to say which has a high ohmic resistance and is magnetic, to provide, within the printing machine, a device for thermal energy injection, in which hot gas does not have to be used and by means of which energy injection capable of being controlled with high accuracy in terms of time is possible.

This object is achieved by means for injecting thermal energy inductively into the printing forme therewith to effect an inductive fixing of said data to said printing forme. The means for injecting thermal energy inductively includes at least one inductor and a high-frequency component electrically connected with the inductor to form a reasonant circuit therewith. A power supply unit is connected to the high-frequency component with a supply line.

Together with all the other steps, such as hydrophiling, imaging and erasing, the fixing operation can, of course, also be executed within the printing machine, without the forme cylinder or printing forme being removed.

Since the fixing operation is carried out by means for the inductive fixing of the image information on the rotating printing forme consisting of a material suitable for induction heating, particularly advantageously in the medium-frequency range of 100–500 kHz, a time saving of up to 60% can be achieved, as compared with the hot-gas fixing method described in the prior art.

The invention also provides that by, for example, duplication of inductor loops, the number of regions of energy injection can be increased and, consequently, the active time of the fixing operation reduced, thus resulting, in turn, in an efficiency higher than that of the hot-gas fixing operation and therefore a marked energy saving.

In energy injection by induction, heating within the material, here the image information (thermomaterial), is brought about by means of a high-frequency alternating current. As is known, due to the so-called skin effect, heating can be applied either to a high degree onto the surface by means of high frequencies or else further into the material by means of lower frequencies. At the same time, energy injection is restricted in a punctiform manner, which, as stated, is particularly advantageous in terms of energy consumption.

Although induction heating depends on the material, it may nevertheless be employed in a focussed manner, since action having pinpoint accuracy can be achieved below the inductor loops.

The device according to the invention is therefore not highly suitable for specific printing formes (for example, those consisting of copper since the ohmic resistance is very low, or of aluminium), but it can be used with high efficiency for a large number of printing formes conventionally employed.

Suitable printing formes and their materials are also described extensively in EP 0 693 371 B1.

The various features of novelty which characterize the invention are pointed out with particularity in the claims annexed to and forming a part of the disclosure. For a better understanding of the invention, its operating advantages, and specific objects attained by its use, reference should be had to the drawing and descriptive matter in which there are illustrated and described preferred embodiments of the invention.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

DETAILED DESCRIPTION OF THE PRESENTLY PREFERRED EMBODIMENTS

Figure 1:
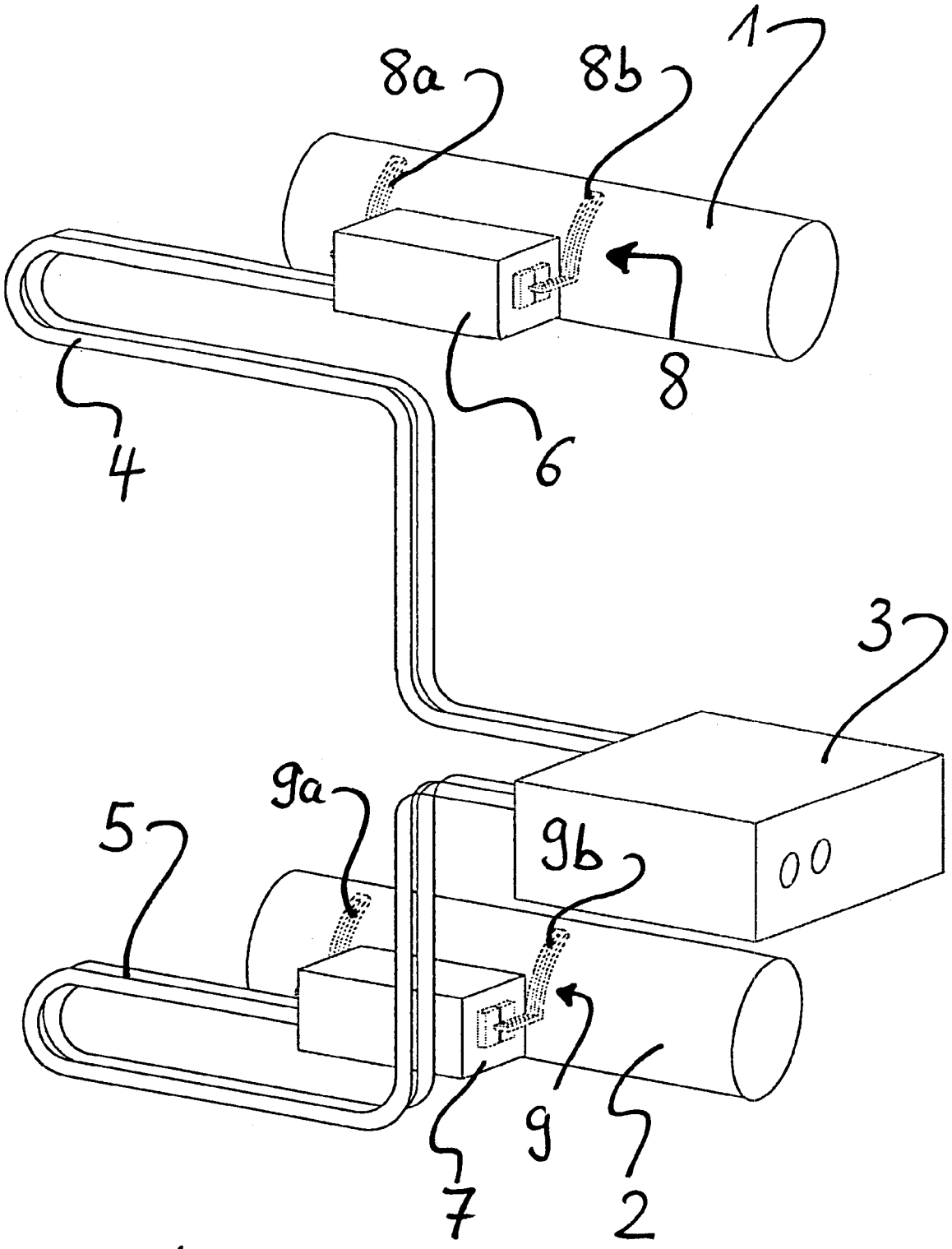
FIG. 1 is a perspective depiction of a device according to the invention for thermal energy injection into printing forme surfaces.

FIG. 1 shows, in an exemplary embodiment, the means for the inductive fixing of the image information on two rotating printing formes 1, 2 of cylinder configuration consisting of a material suitable for induction heating. The make-up of the induction generator comprises at least one supply unit 3 which is arranged at a fixed location in or on the printing machine and is coupled to two high-frequency (HF) components 6, 7 by means of supply lines 4, 5 (HF lines) suitable for high frequency. Each HF component 6, 7 forms a structural unit, in each case with an inductor 8, 9, being electrically conducted therewith and in each case forms with the latter a resonant circuit. Each inductor 8, 9 comprises two inductor loops 8*a*, 8*b* and 9*a*, 9*b* which are in each case arranged on the end face of an HF component 6, 7.

All the inductor loops 8*a*, 8*b* and 9*a*, 9*b* are oriented parallel to the circumferential direction of the respective printing forme cylinder 1, 2. In the exemplary embodiment, the inductor loops 8*a*, 8*b* and 9*a*, 9*b* copy approximately the curvature of the respective cylinder circumference surface, so that they describe a coaxial shell in relation to the rotating printing forme cylinder 1, 2 and introduce heat annularly or introduce heat with very high focussing accuracy onto the respective cylinder surface according to on/off switching simply in a way corresponding to the inductor shape, that is to say to the length of the extent in the circumferential direction.

The inductor shape is advantageously independent of the type of printing forme or of whether, for example, heat is injected into a plate or a sleeve.

The HF components 6, 7 preferably operate in the medium-frequency range of 100 to 500 kHz.

It may of course also be envisaged to design the inductor, that is to say an inductor loop, in the form of a hairpin inductor (line inductor) having the width of the printing forme, for the purpose of a homogeneous introduction of heat into the respective cylinder surface.

In the present example, the supply unit 3 can selectively operate two HF components 6, 7 jointly or separately, but, of course, an arrangement with separate supply units for each HF component may also be envisaged within the meaning of the invention.

The focussed adaptation or the discovery of a suitable inductor shape was an essential constituent of the present invention.

The preferred exemplary embodiment of an inductor 8 shown, with two inductor loops 8*a*, 8*b* which in each case have an elongate design parallel to the circumferential direction of the cylinder surface 1, operates the most reliably in the printing machine.

However, other shapes of the inductor or inductor loops may be envisaged for different applications. Thus, the inductor loop could have an oblique position in relation to the circumferential direction of the printing forme cylinder, so that format variability of the printing forme can be taken into account more effectively.

In order to achieve the desired homogeneous (uniform) or punctiform (point-to-point) heating of the surfaces of the printing forme cylinders 1 and 2, there is provision for traversing the inductor 8, 9, in a structural unit with the HF component 6, 7, in the axial direction of the rotating printing formes 1, 2.

However, the HF component and the inductor do not have to constitute a structural unit, but the HF component may also be arranged at a fixed location in the printing machine and be coupled to the traversable inductor via flexible leads.

A multiplicity of parallel energy injection zones (heating zones) may also be achieved in the circumferential direction of the printing forme cylinders 1, 2 (in order to achieve heating of the complete printing surface), in that a coil-like or spiral inductor which is elongate (of the width of the printing forme) and is arranged axially parallel to the printing forme cylinder is coupled, rotating about its axis parallel to the printing forme cylinder, to the fixed-location HF component or components via rotatable connections.

As is known, a large number of guards, finger guard rods, emergency stop switches, etc., which are necessary on the individual assemblies, are provided in a printing machine.

In an advantageous version, there is provision for the inductor to be integrated in the finger guard in the nip zone between a printing forme on a printing forme cylinder and a rubber-blanket cylinder, as a result of which a particularly space-saving variant could be implemented.

The present device for inductive thermal energy injection is designed, in particular, for printing formes imaged by means of a laser-induced thermotransfer method, but it may also be envisaged to satisfy the heat demand elsewhere within the printing machine, for example in the form of an inductively heated drier.

Figure 2:
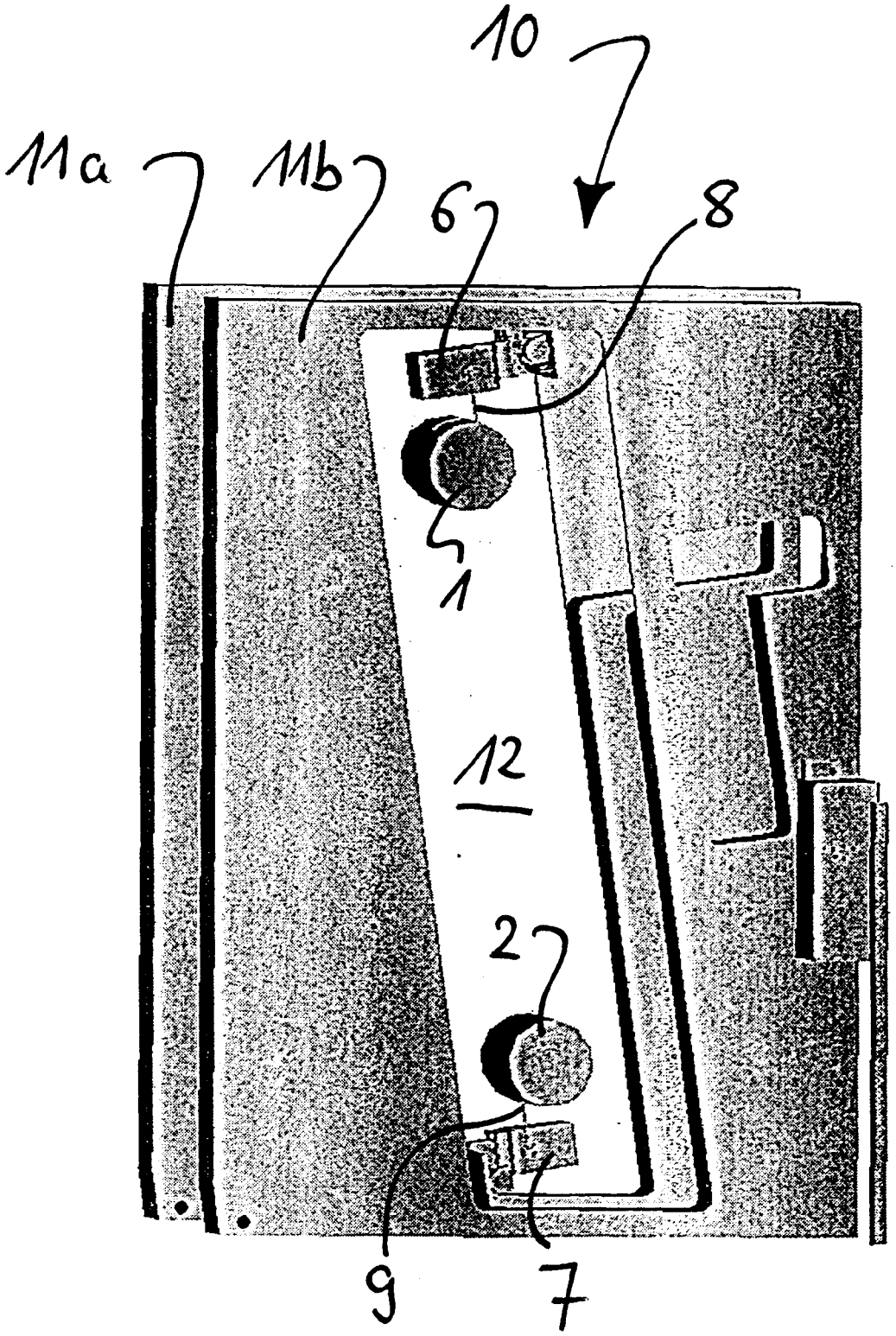
FIG. 2 is showing of a double printing unit without a rubber-blanket cylinder, with printing forme cylinders which are moved apart from one another and on which the arrangements of two devices for thermal energy injection can be seen.

FIG. 2, however, shows the preferably implemented possibilities for arranging an induction generator in the printing unit of a rotary printing machine. Two forme cylinders 1, 2, which are moved apart from one another and co-operate in each case with a rubber-blanket cylinder, not shown, can be seen in a double printing unit 10 which is indicated by two side walls 11*a*, 11*b* and a shaft 12 lying therein for the cylinder arrangements.

The printing unit 10 shown relates to digitally inscribable and also re-erasable offset impression cylinders 1, 2. The printing unit 10, like a conventional printing unit, comprises printing formes 1, 2, rubber-blanket and impression cylinders, and also inking and dampening units. As in the prior art described in the introduction, imaging units, erasing and rubber-blanket cylinders and washing systems are provided for each printing forme 1, 2. The fixing unit with HF component 6, 7 and inductor 8, 9 can be seen.

As is known, on the one hand, the imaging unit can be thrown on and off in relation to the printing forme by means of a special mechanism and, on the other hand, when the impression cylinders are capable of being thrown off from one another, for example for the purpose of taking into account format variability of the printing forme, the imaging unit can, of course, correspondingly be moved in accompaniment. The inductor 8, 9 can be moved in accompaniment in exactly the same way, for which purpose it is advantageously permanently assigned, in conjunction with its HF component 6, 7, to the imaging unit.

The invention is not limited by the embodiments described above which are presented as examples only but can be modified in various ways within the scope of protection defined by the appended patent claims.

Thus, while there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

We claim:

1. A device for fixing digital data information imaged on a printing forme with thermal energy while said printing forme is rotating comprising means for injecting thermal energy inductively into the printing forme therewith to effect inductive fixing of said data to said printing form, wherein said means for injecting thermal energy comprises:

at least one inductor;

a high-frequency component, said high frequency component being electrically connected with said inductor to form a resonant circuit therewith;

a power supply unit; and a supply line connecting said power supply unit with said high-frequency component.

2. A device according to claim 1, wherein said printing forme is of a magnetic material having a high ohmic resistance.

3. A device according to claim 1, wherein said means for injecting thermal energy inductively operates in a frequency range of about 100 to about 500 kHz.

4. A device according to claim 1, wherein said inductor comprises at least two conductor loops.

5. A device according to claim 4, wherein said printing forme is a cylinder, said inductor loops being elongated and oriented parallel to a circumference of said printing forme.

6. A device according to claim 4, wherein said printing forme is a cylinder, said inductor loops being disposed obliquely relative to a circumference of said printing forme.

7. A device according to claim 1, wherein said inductor is a hairpin inductor, said hairpin inductor having a width substantially the same a width of said printing forme.

8. A device according to claim 1, wherein said printing forme is a cylinder, the inductor being traversable axially of the printing forme for injecting thermal energy one of uniformly along the width of the printing forme and at point-to-point locations of said width.

9. A device according to claim 8, wherein the high-frequency component is mountable at a fixed location in a printing machine, and a flexible lead connecting said inductor to said high-frequency component.

10. A device according to claim 1, wherein said high-frequency component and said inductor are constructed as a unit, said unit being traversable axially of the printing forme.

11. A device according to claim 1, wherein said power supply unit is connectable to plural high-frequency components for selectively operating a high-frequency component independently of others of said high-frequency components, and jointly with said others of high-frequency components.

12. A device according to claim 1, wherein said inductor is mountable in a printing machine finger guard in a nip zone between the printing forme on a printing forme cylinder and a rubber-blanket cylinder.

13. A device according to claim 1, wherein the printing forme is a cylinder, the inductor being one of a coil and a spiral of a length substantially equal to a width of the printing forme, means rotatably mounting said one of said coil and said spiral for rotation about an axis parallel to an axis of said cylinder, and rotatable connector means for electrically connecting said one of said coil and said spiral to said high-frequency component.

* * * * *